United States Patent [19]

Vigneron et al.

[11] Patent Number: 4,641,556

[45] Date of Patent: Feb. 10, 1987

[54] METHOD OF AND APPARATUS FOR THE CUTTING OF WINDOWS IN MATS

[76] Inventors: Gerard G. Vigneron, 28, avenue Jean Jaures, Modane (Savoie); Jean C. R. Brulé, Les Neyrolles (Aln), both of France

[21] Appl. No.: 713,424

[22] Filed: Mar. 19, 1985

[30] Foreign Application Priority Data

Mar. 22, 1984 [FR] France ..... 84 05113

[51] Int. Cl.[4] ..... B26F 1/38; B26D 3/00; B26D 5/12

[52] U.S. Cl. ..... 83/36; 83/39; 83/56; 83/455; 83/468; 83/55; 83/614

[58] Field of Search ..... 83/36, 39, 455, 468, 83/555, 614, 56, 581, 71; 33/DIG. 9

[56] References Cited

U.S. PATENT DOCUMENTS

| | | | |
|---|---|---|---|
| 3,130,622 | 4/1964 | Eno | 83/529 |
| 3,213,736 | 10/1965 | Keeton | 83/455 |
| 3,774,495 | 11/1973 | Matthew | 83/522 |
| 3,779,119 | 12/1973 | Broides | 83/581 |
| 3,996,827 | 12/1976 | Logan | 83/455 |
| 4,098,160 | 7/1978 | Weil | 83/468 |
| 4,200,429 | 4/1980 | Weil | 425/295 |
| 4,249,437 | 2/1981 | Hagenson | 83/39 |
| 4,505,174 | 3/1985 | Carithers | 83/614 X |

*Primary Examiner*—Donald R. Schran

*Attorney, Agent, or Firm*—Karl F. Ross; Herbert Dubno

[57] ABSTRACT

A method of and an apparatus for the cutting of rectangular windows on mats provides a pair of blades on respective tracks which are simultaneously displaced to cut a pair of mutually perpendicular cuts in a blank positioned on a worktable. The blade carriages are actuated by pneumatic cylinders and in turn carry pneumatic cylinders for raising and lowering the blades. The margins of the mat are defined by adjustable bars whose perpendicular distances from a reference point, represented by the junction of the paths of the cuts, can be set.

9 Claims, 2 Drawing Figures

METHOD OF AND APPARATUS FOR THE CUTTING OF WINDOWS IN MATS

FIELD OF THE INVENTION

Our present invention relates to a method of and to an apparatus for the cutting of rectangular windows in mats and, more particularly, the cutting of such windows in bodies adapted to be used for artistic presentation, e.g. in a frame. The term "rectangular" as used herein will be understood to include square shapes.

BACKGROUND OF THE INVENTION

The framing of prints, watercolors, photographs and other surface displays is frequently effected utilizing a frame with or without a glass pane behind which the artistic work is mounted, and a mat which is formed with a rectangular window through which the display is viewed and which contriubutes to the appearance of the framed work.

The mat is generally formed of a relatively thin cardboard or paperboard and itself forms a mask for the perimeter of the work or the background material upon which the work is mounted.

The exposed surface of the mat can have a color selected to complement the work of the frame or can be colorless or white, can have a grainy appearance or texture or a smooth and uniform appearance, can be covered or composed of fabric or can have a fabric texture or can be devoid of any type of significant surface formation. The mat is provided with a rectangular window, i.e. a window which can be square or elongated in a selected direction and the width of the margin around this window will define a margin around the exposed portion of the work to be displayed in a decorative or complimentary manner.

In the past, such mats have been produced by cutting out the window with various mat cutting tools and instruments.

A blade is generally slid along a guide to cut one side of the window to be formed and either the blade assembly or the mat can then be reoriented so that the same blade assembly cuts the sides at right angles to the first mentioned side. Means can be provided for limiting the stroke of the blade and thus defining the width of the margins or borders of the mat which remain.

It will be apparent that such mat-cutting devices are not fully suitable for the production of a series of mats of the same dimensions with similar cut-outs because, generally speaking, the longitudinal cuts must alternate with transverse cuts and the succession of cuts involves several movements of the mat relative to the cutting table or the cutting means.

Since the complete cutting of a window in a mat requires at least two distinct cutting phases in which the mat must be positioned, a number of manipulations of the mat are generally required for the production of each window and, of course, the various manipulations and the time-consuming repositioning of the mat at least once during each window-cutting operation, present drawbacks to use of the system for the mass production or serial productions of mats even if the windows are intended to be identical.

If one does not wish to alter the set-up, it is possible to make corresponding cuts in a number of mat blanks before making the cuts transversely thereto, in which case it is necessary to restack the blanks after the cuts of one type are made and run the blanks through the apparatus again when the second type of cut is to be made.

OBJECTS OF THE INVENTION

It is the principal object of the present invention to provide an improved mat-cutting method and apparatus whereby the aforedescribed drawbacks are obviated.

Another object of this invention is to provide an improved method of cutting mats which is conductive to the serial or mass production of mats having identical rectangular windows cut therein.

Another object of this invention is to provide an improved mat-cutting apparatus which can be utilized with minimum repositioning a mat blank to cut a complete window therein.

SUMMARY OF THE INVENTION

According to the invention, a mat-cutting method and apparatus is provided which allows a single set-up, indeed, the complete formation of a rectangular window without the need for storage of intermediate products and without the need to readjust each blank in the apparatus apart from a rotation so that the entire mat-cutting operation is significantly simplified and accelerated.

According to the invention, this is achieved by positioning a blank of cardboard or paperboard on a planar work surface below mutually perpendicular guide tracks, then cutting a pair of mutually perpendicular edges of the window by movement of respective blades along these tracks, rotating the blank in its plane through 180° and then returning each of the blades in the opposite direction to cut the two other mutually perpendicular sides of the rectangular window.

According to the invention, therefore, substantially simultaneously two blades are advanced in respective directions to cut two adjoining sides of the window and since each window is made up of just two pairs of such angularly adjoining sides, the complete cutting of the window requires only two strokes of the apparatus each involving the movement of a pair of blades in two directions.

The two mutually perpendicular cuts with each stroke are executed substantially simultaneously and define respectively the width and length of the window. The reverse operation upon rotation of the blank or the same operation repeated after rotation of the blank cuts the other two edges of the window. The window can thus be totally cut out from the mat without intermediate storage, without readjustment of the device and without any supplemental manipulations.

According to a feature of the invention the blank is positioned on the cutting surface so that the point which will be a corner of the future window is aligned with an intersection of the cutting lines of the two blades which may be common to all of the possible cuts made by the blade system. This point is therefore a fixed point of reference with respect to the track. When the blank is then rotated subsequently, the diagonally opposite point adapted to coincide with a corner of the window is positioned at the reference point. This reference point is also used as the origin of the measurement indicia provided along each track to set the strokes of the respective blades. This in turn, defines the length of the size of the window cut by the tools.

According to the apparatus aspect of the invention, the guides or tracks are provided with blade carriages upon which the respective blades are adjustably mounted and are provided with respective drive elements, e.g. pneumatic cylinders for displacing these supports. The guide tracks or rails are fixed upon the table or relative to the latter so that the two blades meet and their paths coincide at the aforementioned reference point which can also be provided with a stop for both of the blade support carriages.

The positioning of the blank upon the table, however, can be effected by providing a pair of bars defining a right angle and constituting an adjustable square having one arm movable along the table and the other arm, at right angles to the first, movable along the first arm. Appropriate scales can be provided to allow setting of the positions of the arm and the arms can be provided with locking devices for fixing them in place.

The two cylinders are synchronized so that one of the blades will arrive at the intersection point before the other and move away from the intersection point before the arrival of the second blade to prevent collision.

The translation guides can be formed with movable blocks or stops constituting controllable abutments defining the ends of the actuation heads of the respective cylinders and thus the length of the cuts. Other cylinders on the blade supports or carriages can serve to control the depth of penetration of the blades into the paperboard blank before translation is effected.

Preferably the apparatus also has a pressing device, likewise in the form of a square, which can be actuated by a cylinder adapted to bring it forth or back of the work surface and whose two arms are parallel to the path of the cuts so as to brace the blank against the table after it has been positioned.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
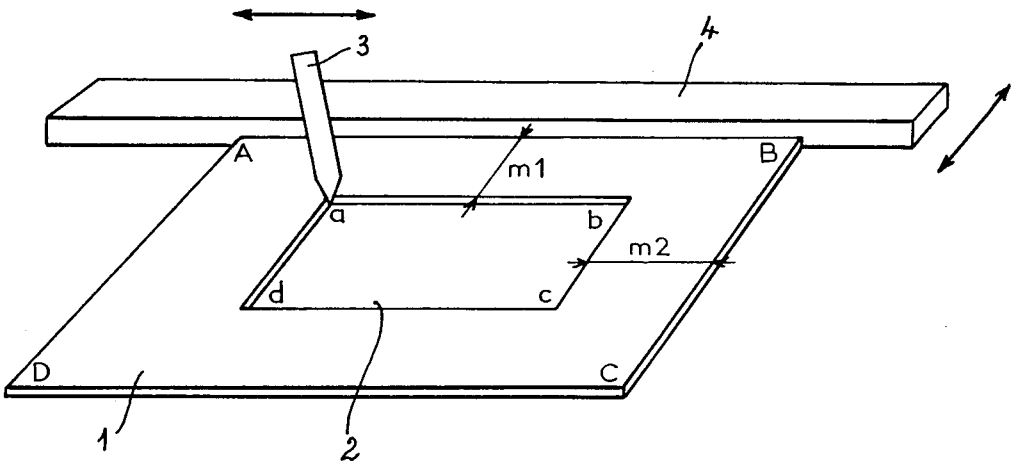
FIG. 1 PRIOR ART
FIG. 1 is a diagrammatic prespective view illustrating the principles of prior-art mat cutting.

In FIG. 1 of the drawing, we have shown the prior art technique for producing a mat utilizing a single blade which can be displaced along a single guide not shown. Generally, the apparatus, which is here represented in a highly simplified form, comprises a bar 4 against which a paperboard or cardboard blank 1 is positioned to set the line to be cut at the proper distance m1 corresponding to the width of the mat in this region, from the edge of the blank and hence from the bar 4 which is adjustable to control the width of the margin.

The window which is cut in the blank 1 has been represented at 2 and is rectangular.

The blade 3 is shiftable parallel to the bar 4 and thus can make the cut a-b, the length of which may be controlled by abutments for the carrier of the blade 3.

The blank is then rotated through 180° in its plane to bring the side C-D against the bar 4, and the side c-d of the window is then cut.

To avoid resetting of windows when a series of mats is to be cut, the mat is then freed from the worktable by elevation of a presser, if one is provided, and stacked until the second set of cuts is to be made.

The stroke of the blade is then adjusted to a length corresponding to the short sides of the rectangular opening and, for example, the side B-C of the blank is placed against the bar 4 and the cut c-b is made, whereupon the blank is rotated again through 180° and the cut a-d is made defining the margin m2. The stocked intermediate pieces are all cut in a similar manner leaving the windows 2 therein.

The complete cutting of a window, therefore, requires two distinct operating phases with insertion and removal of the blanks and intermediate storage and two rotations in addition to two settings of the device all in a labor-consuming and time-consuming manner.

Figure 2:
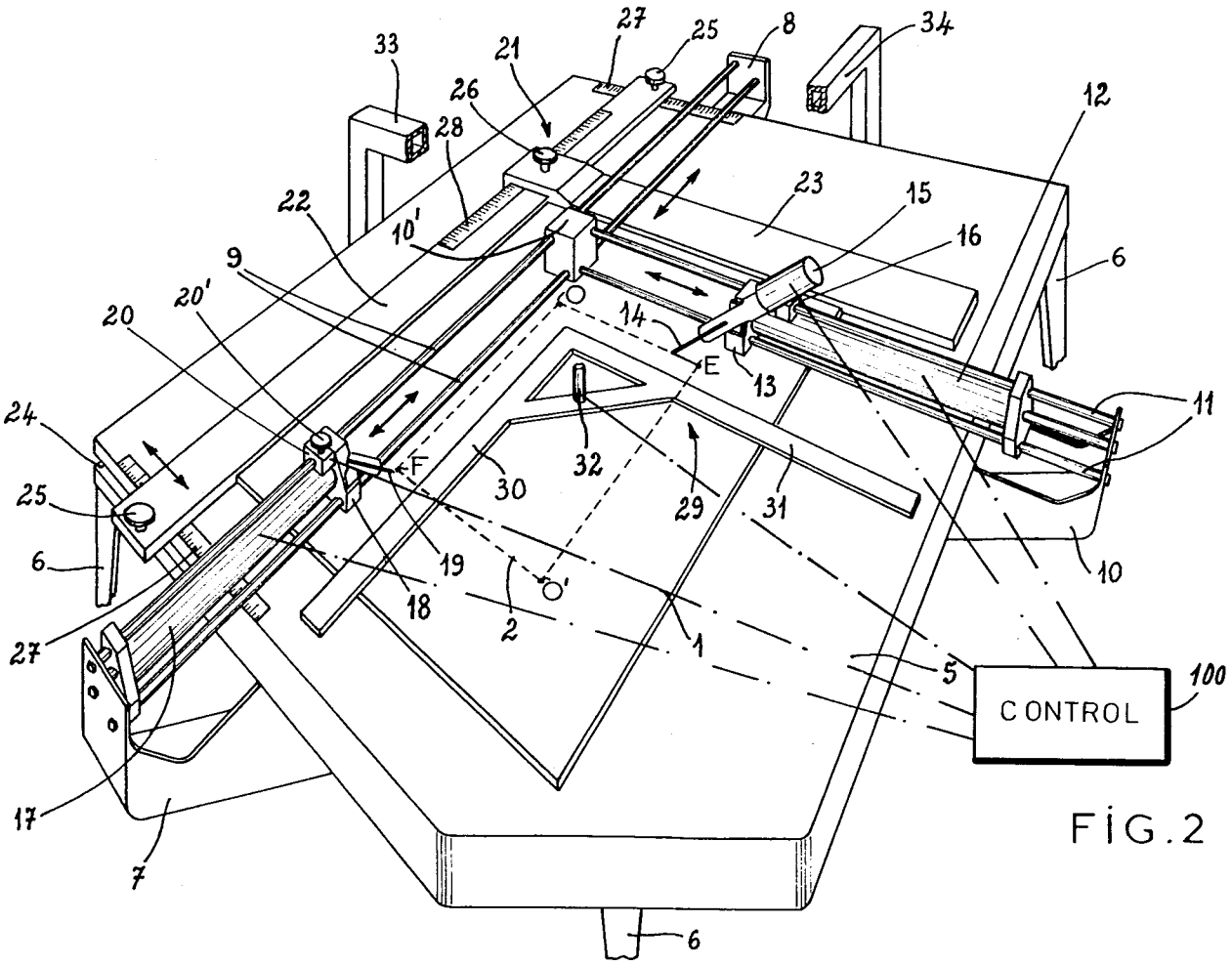
FIG. 2 is a perspective view, partly broken away, and in highly diagrammatic form, of an apparatus according to the invention.

With the invention, however, as shown in FIG. 2, the cutting table 5 is provided with legs 6 and defines a work plane or cutting surface onto which the blank 1 can be placed.

A pair of fixed supports 7 and 8 along sides of the table fixedly position a pair of rails forming a track 9. Another pair of rails forms the transverse guide or track 11 which lies at a right angle to the track 9.

The track 11 is supported between a block 10', which can be disposed immediately adjacent the reference point O, and a support 10 of the table carrying the track 11.

The first pneumatic cylinder 12 for effecting translation of a blade carriage 13 has its piston rod connected to the support 10 and is in turn connected to the carriage 11. The support carriage 13 receives a first blade 14 which is slidably mounted on this carriage and can be raised and lowered by another pneumatic cylinder 15 which controls the depth of penetration of this blade into the paperboard blank 1. On at least one of the rails of the track 11 a block 16 is adjustably mounted to form a stop for the carriage 13 and thus limit the displacement of a blade from the reference point and hence the length of the cut to be formed thereby. A screw can lock this stop along its rail.

A second pneumatic cylinder 17 for translation of the other blade has its piston rod fixed to the support 7 while the body of the cylinder has, at its end, the second carriage 18 which is slidable along the track 9, its displacement being limited by another stop 20 mounted on one of the rails of track 9 and adapted to be adjustably clamped to the latter by a screw 20'.

A blade 19 is slidably mounted on the carriage 18 and is likewise controlled by a pneumatic cylinder which regulates its penetration into the blank by raising and lowering the blade selectively. This cylinder is not visible in FIG. 2 but is analogous to that shown at 15.

A square 21 for setting the margins of the mask is also provided and comprises two movable arms 22 and 23, respectively engageable with longitudinal and transverse edges of the blank and defining a right angle between them.

The longitudinal arm 22 is mounted so as to move slidably in the transverse direction, i.e. parallel to the track 11, and its position can be established by scales 27 representation perpendicular distance of the bar from the reference point and hence the width of the longitudinal margin. Locking screws can clamp the bar 22 in place and its displacement parallel to itself is ensured by having the bar provided with wheels riding in grooves 24 in the edges of the table.

It may be remarked that the apparent distortion from the rectangular in FIG. 2 is a result of the prespective showing.

The second arm 23 of the square 21 rides on the bar 22 and its position with respect to the reference point can be set via a scale 28 and the locking screw 26, the perpendicular distance of the arm 23 from the reference point O being equal to the transverse margin.

The apparatus also comprises a pressing device 29 in the form of a square having longitudinal and transverse branches 30 and 31 parallel respectively to the longitudinal and transverse translation tracks 9 and 11. The square is connected by a piston rod 32 to a pneumatic cylinder which is mounted on a support overhanging the guide tracks and broken away so that only the bars 33 and 34 of this support can be seen.

The apparatus below the table can be provided with means for feeding the pneumatic cylinders, with a compressor and with controls for the cylinders which may be required, these having been represented by block 100 shown in FIG. 2.

Before cutting a series of blanks to form rectangular bodies of given directions, the square 21 is positioned to set the longitudinal and transverse margins and the stops 16 and 20 are set to establish the desired length of cut.

The blank 1 is introduced below the presser 29 and its longitudinal and transverse edges are brought into contact with the arms 22 and 23. The presser 29 is thereupon lowered and the two blades are actuated to pierce the blank and then draw these blades along the respective cuts O-E, and O-F, substantially simultaneously and synchronously. Because of an offset in the feeding of the cylinders, the second blade can arrive at the reference point O only after the first blade has retracted, i.e. withdrawn from the blank. After the formation of the two cuts and the interaction of both blades, the presser 29 is elongated and the blank is rotated through 180° to position the point O' representing the diagonally opposite corner of the window to be formed at the reference point. The presser is then lowered, the cylinders 50 etc. for piercing the blank are actuated and the cylinders 12 and 17 are actuated to form the cuts F-O' and E-O' practically simultaneously thereby forming the complete window.

The presser is then raised, the cutout portion discarded and the finished mat removed.

The carriages 13 and 18 are provided with means enabling the blades to be tilted not only with respect to the cut line as shown but also with respect to the plane of the blank so that an inward or outward chamfer or bevel can be formed on the cut edge.

Naturally, the cylinders can be arranged so that they move alternatively toward and away from the reference point to ensure no collision between the blades.

A new blank can then be inserted and the process repeated.

It will be apparent that various modifications of this structure are possible within the scope of the appended claims. For example, the cylinders can be fixed and connected to the movable carriages by their piston rods or some other actuating system may be used for displacing the carriages. In place of cutting blades, lasers can be used. Instead of a pressing square, some other holddown means can be used, e.g. rollers, bars, rulers or the like which can be brought into contact with the blank by the cylinders accompanying the cutting tools.

Finally, the apparatus can be used with means permitting automatic feed of the blanks to removal of the finished mats and the waste, and means for automatically rotating the blanks.

We claim:

1. A method of cutting rectangular windows in blanks to form mats for display purposes, comprising the steps of:

positioning a blank of sheet material on a support surface so that a vertex of a first potential corner of a window to be formed in said blank is positioned at a reference point on said surface for all sizes of mats corresponding to a junction of the path of two blades displaceable mutually perpendicular and upon rotation;

forming a pair of cuts with said blades respectively along two perpendicular lines fixed with respect to the surface in said blank adapted to form two adjoining sides of a rectangular window therein;

rotating said blank in its plane through 180° to position a point of said blank corresponding to a vertex of a diagonally opposite corner of said window at said reference point; and forming two mutually perpendicular cuts in the blank with said blades whereby said cuts delimit a rectangular window in said blank to form said mat.

2. The method defined in claim 1, further comprising the step of displacing bars to predetermined perpendicular distances from said reference point on said surface to form stops for angularly adjoining edges of said blank and to define respective margins of the mat.

3. The method defined in claim 2 wherein said blades are displaced substantially simultaneously to form said cuts in said blank.

4. An apparatus for cutting rectangular windows in blanks of sheet material to form display mats, said apparatus comprising:

a table having a planar cutting surface;

means forming a pair of mutually perpendicular tracks fixed on said table;

respective cutter carriages linearly displaceable along said tracks;

respective cutting means on said carriages for forming respective cuts in a blank on said table having an intersection at a reference point fixed on said table for all sizes of mats to be cut; and a movable square having a pair of mutually parallel arms adjustable on said table relative to said tracks and relative to one another to predetermined perpendicular distances from said reference point to establish the widths of respective margins of said mat.

5. The apparatus defined in claim 4 wherein each of said carriages is provided with a respective blade engageable in the respective blank, said apparatus further comprising respective cylinders connected to said carriages for simultaneously displacing same in mutually perpendicular directions along the respective tracks.

6. The apparatus defined in claim 5 wherein said cylinders have cylinder bodies connected to said carriages and piston rods connected to fixed supports for the respective tracks.

7. The apparatus defined in claim 6, further comprising respective cylinders on said carriages for displacing said blades into and out of engagement with said blank.

8. The apparatus defined in claim 6, further comprising respective stops adjustably positioned along said track for controlling the length of cuts of the respective blades.

9. The apparatus defined in claim 6, further comprising a presser actuatable by cylinder means for holding said blank against said surface.

* * * * *